United States Patent [19]

Sanada

[11] 4,329,074

[45] May 11, 1982

[54] RIBBON SWITCHING DEVICE FOR A PORTABLE TYPEWRITER

[75] Inventor: Kokichi Sanada, Tokyo, Japan

[73] Assignee: Fuji Seiko Kabushiki Kaisha, Tokyo, Japan

[21] Appl. No.: 161,795

[22] Filed: Jun. 23, 1980

[51] Int. Cl.[3] ..... B41J 35/14

[52] U.S. Cl. ..... 400/216.5; 400/216.1

[58] Field of Search ..... 400/216.5, 216.1

[56] References Cited

U.S. PATENT DOCUMENTS

| | | | |
|---|---|---|---|
| 865,894 | 9/1907 | Hess | 400/216.5 |
| 1,040,298 | 10/1912 | Felbel | 400/216.5 |
| 1,040,405 | 10/1918 | Pool | 400/216.5 |
| 1,046,893 | 12/1912 | Strother | 400/216.5 |
| 1,050,248 | 1/1913 | Strother | 400/216.5 |
| 2,152,848 | 4/1939 | Helmond | 400/216.5 |
| 2,498,781 | 2/1950 | Wise | 400/216.5 |
| 3,666,069 | 5/1972 | Suzuki | 400/216.5 |

FOREIGN PATENT DOCUMENTS

| | | | |
|---|---|---|---|
| 324217 | 8/1920 | Fed. Rep. of Germany | 400/216.5 |

*Primary Examiner*—William Pieprz

*Attorney, Agent, or Firm*—McAulay, Fields, Fisher, Goldstein & Nissen

[57] ABSTRACT

A typewriter for portable use comprises a plurality of type lugs, a plurality of operation keys and key levers for operating the type lugs; a carriage for supporting paper, a spacing means for moving the carriage one space, and a ribbon switching means provided in contact with the spacing means so as to be moved by the movement of the spacing means. A ribbon holder is shifted vertically to select the required color section of a two color ribbon. Further, many parts of the ribbon switching means are adapted to easy manufacture, and to allow the extensive use of plastics in the construction.

7 Claims, 6 Drawing Figures

RIBBON SWITCHING DEVICE FOR A PORTABLE TYPEWRITER

BACKGROUND OF THE INVENTION

1. Field of the Invention

The present invention generally relates to a typewriter which may be simply and inexpensively fabricated and assembled for portable use. More specifically, the present invention relates to an improved ribbon switching mechanism for a typewriter.

2. Description of the Prior Art

In prior typewriters, a ribbon switching device is provided to allow use of a two color ribbon. When a lower color section of the two color ribbon is used, the ribbon is shifted up by the ribbon switching device. One typical conventional ribbon switching device is schematically illustrated in FIG. 1, which shows the device in the position to use the lower portion of the ribbon. When a ribbon switching key 1 is moved in the direction of arrow A, this action is transmitted by a link 2 to a crank 3. Rotation, thus, of the crank 3 in a counterclockwise direction as seen in the figure moves the end of a link 4 engaging in a T-shaped slot in a crank 5 toward the left side of the T-shaped slot. When a key is pressed to type a character, the link 4 is pulled downward in the diagram and by engaging with the T-shaped slot in the crank 5, rotates the crank 5 counterclockwise as shown in the figure, whereby the linkage consisting of a link 6, crank 7 and ribbon holder 8 is activated to raise the ribbon. It will be seen that switching the link 4 between left and right hand ends of the T-shaped slot in the crank 5, the leverage provided by the crank 5 is adjusted so that the type hammers hit either the upper or lower portion of the ribbon according as the link 4 is at the left or right hand side respectively of the T-shaped slot. Since a portable typewriter is manufactured to be compact, it is necessary to reduce its weight and number of parts. Such a conventional ribbon switching device, however, comprises many parts, many of which are made of metal except for the switching key, thereby increasing weight and cost.

SUMMARY OF THE INVENTION

Therefore, it is an object of the present invention to provide a typewriter for portable use which may be inexpensively fabricated and assembled.

Another object of the present invention is to provide a typewriter having an improved ribbon switching device which is simple, light and easy to manufacture.

The above and other objects are achieved in the present invention by providing a typewriter comprising a plurality of type lugs, a plurality of operation keys and key levers for operating the type lugs, a carriage for supporting paper, a spacing means for moving the carriage one space, a ribbon switching means provided in contact with the spacing means so as to be moved by the movement of the spacing means, whereby a ribbon holder is shifted vertically to select the required color section of a two color ribbon. Further, many parts of the ribbon switching means are adapted to easy manufacture, and to allow the extensive use of plastics in the construction.

BRIEF DESCRIPTION OF THE DRAWINGS

The present invention will become more fully understood from the detailed description given below, and the accompanying drawings of a preferred embodiment of the present invention, which, however, are not to be taken as limitative of the present invention in any way, but are for the purpose of elucidation and explanation only.

DESCRIPTION OF THE PREFERRED EMBODIMENT

Figure 1:
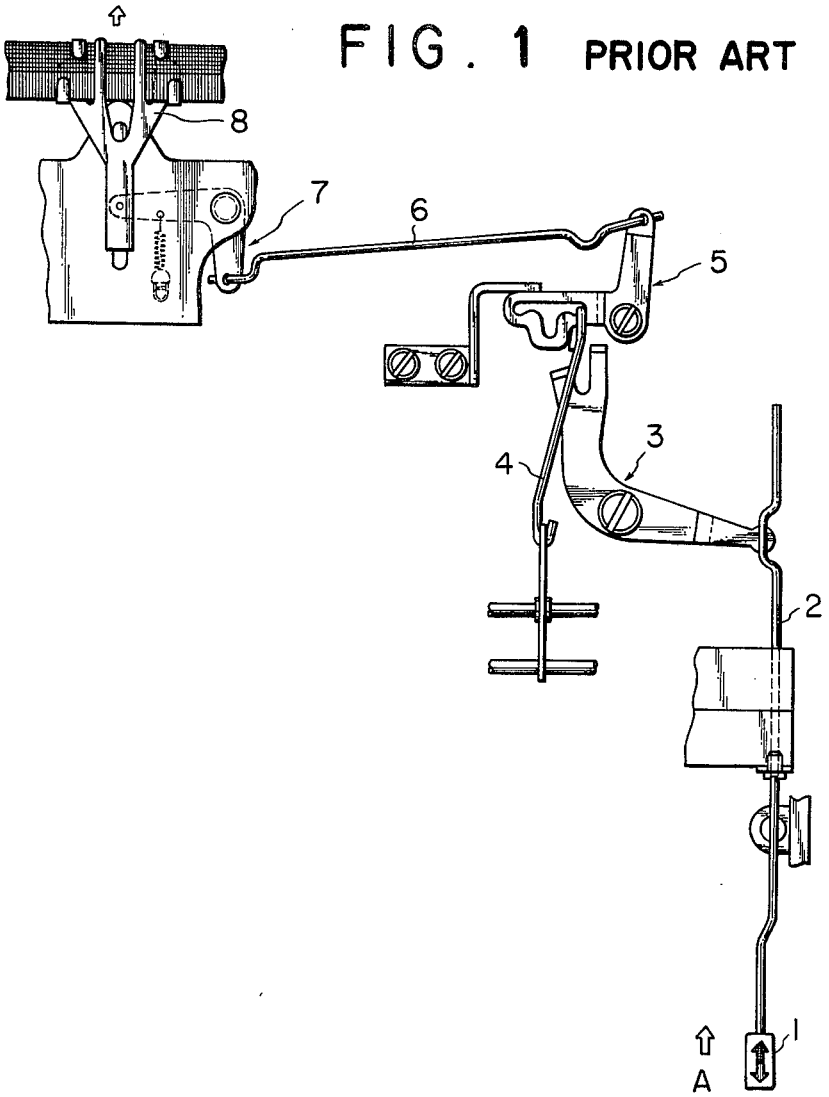
FIG. 1 PRIOR ART
FIG. 1 is a perspective view of a conventional ribbon switching device.
Figure 2:
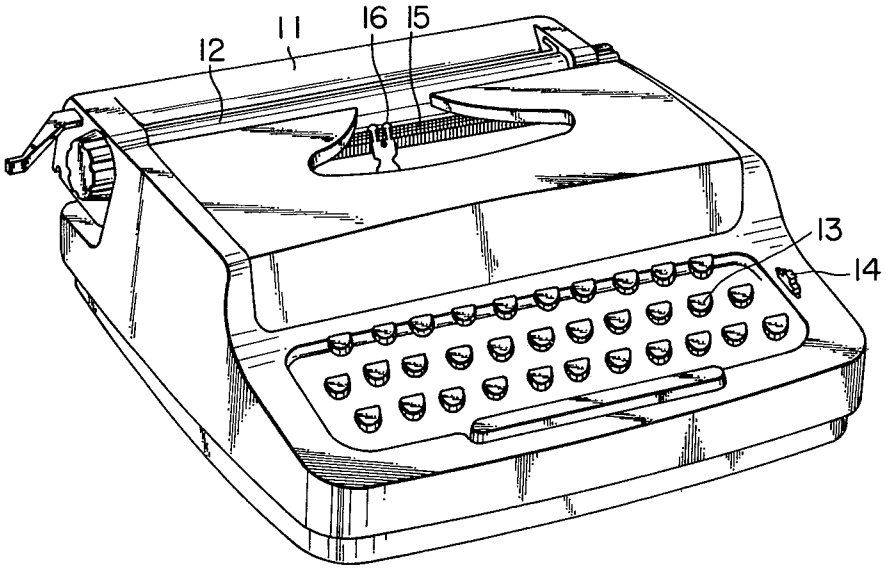
FIG. 2 is an overall perspective view of a typewriter in which a ribbon switching device in accordance with the present invention is provided.

Referring now to the drawings, particularly to FIG. 2, there is illustrated a portable typewriter in which a typewriter ribbon switching device in accordance with the present invention and a two color ribbon are provided. In the figure, the numeral 11 designates a carriage in which a platen 12 is pivotably supported. The numeral 13 designates keys for operating type lugs. The numeral 14 designates a ribbon switching key which is connected to a ribbon switching device. The numeral 15 designates a typewriter ribbon having two colors such as black and red. The numeral 16 designates a ribbon holder.

Figure 3:
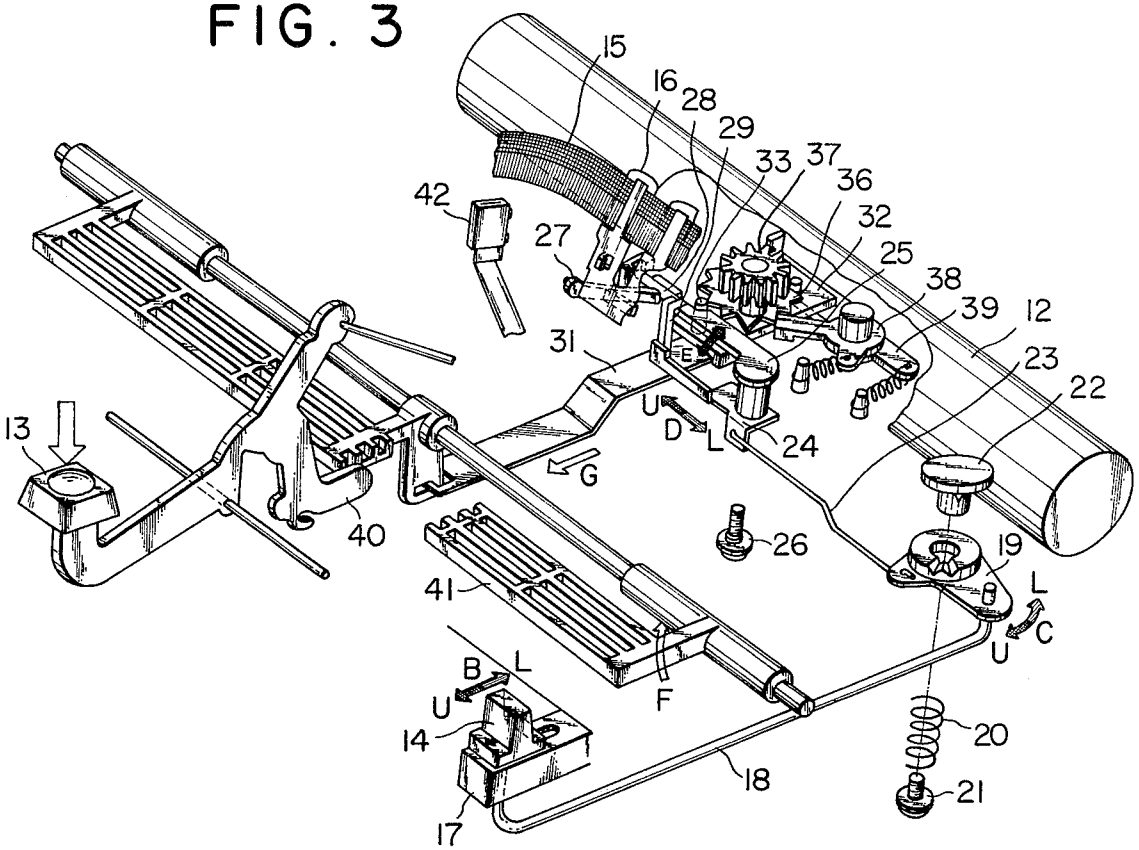
FIG. 3 is a perspective view of a preferred embodiment of a ribbon switching device in accordance with the present invention.

FIG. 3 shows a preferred embodiment of a ribbon switching device in accordance with the present invention. The switching key 14 is mounted on a key guide 17 so as to move in the alignment of arrow B. One end of a first link wire 18 is connected to the bottom of the switching key 14, and the other end is connected to an intermediate crank 19. The intermediate crank 19 is rotatably supported by a crank cap 22 having a seating plate, a coil spring 20 and a bolt 21. As shown in the figure, in the crank cap 22 is formed a threaded hole into which the bolt 21 screws. Further, a projection is formed on the seating plate of the crank cap 22 so as to engage with either of two depressions formed in the intermediate crank 19. By this engagement, rotation of the intermediate crank 19 is limited so that the switching position is maintained except when the switching key 14 is operated. One end of a second link wire 23 is connected to the intermediate crank 19, and the other end is connected to a switch base 24. On the switch base 24 is rotatably mounted a switching arm 25. The adjusting plate 24 is mounted so as to slide reciprocally along the direction of arrow D, and simultaneously the switching arm 25 is moved together with the switch base 24. The switching arm 25 is mounted on the switch base 24 by a stepped bolt 26, which allows the switching arm 25 to rotate in the direction of arrow E about the bolt 26.

Figure 4:
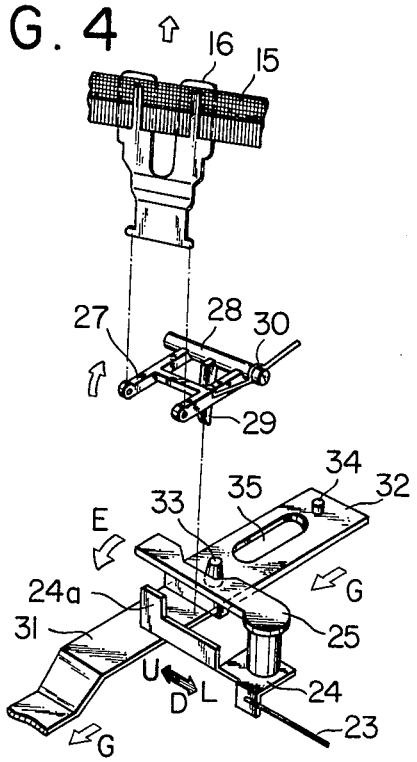
FIG. 4 is a partial exploded perspective view of the ribbon switching device of FIG. 3.

Referring to FIG. 4, the typewriter ribbon 15 is held by a ribbon holder 16 which is supported by a ribbon crank 27 of a ribbon shifting means. In the ribbon shifting means, the ribbon crank 27 is formed integrally with a ribbon crank shaft 28 which is rotatably supported by a well known bearing means, and with which an operating bar 29 is also integrally formed. The operating bar 29 is held in contact with the side edge of the switching arm 25 by means of a torsion spring 30 which is provided on the ribbon crank shaft 28.

A connecting strip 31 is provided with one end under the switch base 24 and is connected to a push plate 32 which is a part of a spacing mechanism for moving the carriage 11 one space. The push plate 32 is provided with two projections 33 and 34 one at each end and an elongated slot 35. A base gear 36 is provided in the slot 35 as shown in FIG. 3 in such a way that the push plate 32 can move freely. A pinion gear 37 is secured on the base gear 36 and is rotated together so as to move the carriage 11. The numerals 38 and 39 designate components of an escapement mechanism.

Figure 5A:
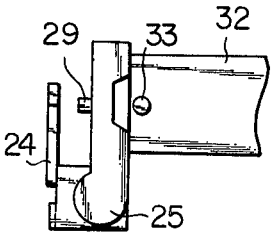
FIG. 5*a* is a schematic plain view of the switching mechanism of FIG. 4, in the position to use an upper color section of a two color ribbon.

When the switching key 14 is moved in the direction U of the arrow B, the intermediate crank 19 is rotated in the direction U of the arrow C by the first link wire 18. Thus, the switch base 24 is moved in the direction U of the arrow D, and therefore, the switching arm 25 is moved in the same direction as the switch base 24. Therefore, the narrower portion of the switching arm 25 is positioned in front of the projection 33 formed on the push plate 32 as shown in FIG. 5*a*. When any one of the keys 13 is pressed down, an actuating arm 40 pushes up a universal bar 41, and the connecting strip 31 is moved in the direction of arrow G. At the same time, the push plate 32 is also moved in the same direction. The projection 34 formed on the push plate 32 moves the base gear 36, one claw of which is engaged with the component 38 of the escapement mechanism so that the carriage 11 is moved one space. Simultaneously, the projection 33 pushes the narrower portion of the switching arm 25 which is thereby rotated in the direction of arrow E. In this position of the switching key 14, a projecting portion 24*a* of the switch base 24 is aligned with the operating bar 29. Therefore, by this movement, the operating bar 29 is pushed a small distance so as to move the ribbon crank 27 slightly upward but this movement is positively limited by the operating bar 29 meeting the projecting portion 24*a*. Thereby, the ribbon holder 16 and the ribbon 15 are shifted up so that a type lug 42 hits the upper color section of the two color ribbon 15.

Figure 5B:
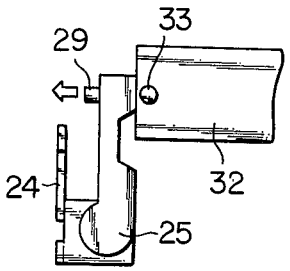
FIG. 5*b* is a schematic plain view of the switching mechanism of FIG. 4, in the position to use a lower color section of a two color ribbon.

On the other hand, when the switching key 14 is moved in the direction L of the arrow B, the switching arm 25 is moved in the direction L of the arrow D. A wider portion of the switching arm 25 is now positioned in front of the projection 33 as shown in FIG. 5*b* and the projecting portion 24*a* of the adjusting plate 24 is no longer aligned with the operating bar 29. When a key 13 is pressed, therefore, the projection 33 pushes the wider portion of the switching arm 25 in the same manner as described above. The switching arm 25 rotates in the direction of arrow E by a larger amount than when the projection 33 pushes the narrower portion of the switching arm 25, and the movement of the operating bar 29 is not limited by the switch base 24, so that the ribbon holder 16 and the ribbon 15 are shifted up higher than in the previous case of shifting to the upper color section. Therefore, the type lug 42 hits the lower color section of the ribbon 15.

As described above, either of the color sections of the ribbon 15 can be selected by switching the switching key 14, and then the corresponding color section is shifted up by actuating any one of the keys 13 for the type lugs 42.

Generally, metal parts require many manufacturing processes such as cutting, bending, plating and so on. On the other hand, when plastic material is used for producing parts, the parts can be generally made by one process only; i.e., a molding process. The structure of many parts of the embodiment illustrated are particularly designed so as to be easily fabricated from molded plastic. Therefore, the parts for this embodiment such as the switching key 14, the key guide 17, the intermediate crank 19, the crank cap 22, the switching arm 25, the ribbon crank 27, the ribbon crank shaft 28, the operating bar 29, and the ribbon holder 16 are made of plastic, for one example, polystyrene resin.

From the foregoing, it will be seen that the present invention provides a simple structure for a ribbon switching device by utilizing a push plate which is one of the component parts of a spacing mechanism for a carriage. Further, since the ribbon is shifted up by using a movement of the push plate, the number of parts required for shifting the ribbon can be reduced. Furthermore, many parts are made of plastic thereby reducing weight and cost. Accordingly, the present invention can provide a portable typewriter having a superior ribbon switching device while reducing its weight and cost.

Although the present invention has been shown and described in terms of the preferred embodiment, it should not be considered as limited to this, however, or mere and simple generalizations, or other detailed modifications. Further variations to any particular embodiment could be made without departing from the scope of the present invention, which is therefore desired should be delimited and defined not by any of the perhaps purely fortuitous details of the shown embodiment, or of the drawings, but solely by the accompanying claims.

What is claimed is:

1. In a typewriter having a ribbon holder, type keys ribbon lifting means for supporting the ribbon holder, a ribbon switching key and an actuating means for actuating a platen when one of the type keys is operated, and an improved ribbon switching device comprising:

said ribbon lifting means including a shaft pivotably mounted on a bearing means, a crank frame for supporting said ribbon holder, an operating bar integrally formed with said shaft and said bar projecting downwardly, and a torsion spring mounted on said shaft and said crank frame for urging downwardly said crank frame about said shaft;

said actuating means comprising a connecting strip movable forwardly in a predetermined stroke when one of said type keys is operated, a push plate connected to said connecting strip for actuating said platen, and a projection integrally formed with said push plate at the forward end thereof;

a reciprocally slidably mounted switch base, a linkage connecting one end of said switch base for operation by said switching key, the other end of said switch base being integrally formed with a projecting portion; and a switching arm pivatably mounted on said switch base, the rear side edge of said switching arm being formed with a lower lifting step and an upper lifting step, said switching arm being located between said projection and said projecting portion, the front side edge of said arm being always contacted with said operating bar; whereby said projection pushes either said lower lifting step or said upper lifting step when a type key is depressed so that said ribbon lifting means is lifted up in a predetermined degree according to the movement of said switching arm.

2. A device in accordance with claim 1, wherein said upper lifting step is a recess formed in the rear side edge of said switching arm, said lower lifting step is the rest of the rear side edge.

3. A device in accordance with claim 1 or 2, wherein said linkage comprises two link wires and an intermediate crank means interposed between said link wires, said crank means having two depressions for engaging a crank cap so that the switching position is maintained.

4. A device in accordance with claim 1 or 2, wherein said ribbon lifting means, said actuating means, said switching base and said switching arm are all made substantially entirely of plastic.

5. A device in accordance with claim 1 or 2, wherein said linkage is connected between said switching base and said switching key.

6. A device in accordance with claim 1, wherein said connecting strip is provided with one end connected to said push plate.

7. A device in accordance with claim 1, wherein said push plate is provided with an elongated slot and a base gear is provided in said slot while permitting said push plate to move freely.

* * * * *